US006740199B2

(12) United States Patent
Khan et al.

(10) Patent No.: US 6,740,199 B2
(45) Date of Patent: May 25, 2004

(54) PROCESS FOR DIGESTING WOODCHIPS WITH A SULTAINE AND A POLYGLYCOSIDE

(75) Inventors: Abdul Q. Khan, Jax, FL (US); George K. Wai, Mountain Lakes, NJ (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 09/915,750

(22) Filed: Jul. 26, 2001

(65) Prior Publication Data

US 2002/0112828 A1 Aug. 22, 2002

Related U.S. Application Data

(60) Provisional application No. 60/221,663, filed on Jul. 27, 2000.

(51) Int. Cl.[7] ..... D21C 3/20
(52) U.S. Cl. ..... 162/72; 162/77; 162/90
(58) Field of Search ..... 162/72, 77, 90, 162/82, 76

(56) References Cited

U.S. PATENT DOCUMENTS

| | | | | |
|---|---|---|---|---|
| 4,891,159 A | | 1/1990 | Nadolsky | 252/545 |
| 4,906,331 A | | 3/1990 | Blackstone et al. | 162/72 |
| 4,913,841 A | * | 4/1990 | Zeman | 516/59 |
| 5,250,152 A | | 10/1993 | Ling et al. | 162/72 |
| 5,298,120 A | | 3/1994 | Blackstone | 162/76 |
| 5,501,769 A | | 3/1996 | Blackstone et al. | 162/76 |
| 5,728,265 A | | 3/1998 | St. Victor et al. | 162/72 |
| 6,036,817 A | | 3/2000 | St. Victor et al. | 162/72 |

FOREIGN PATENT DOCUMENTS

GB 2 155 966 A * 10/1985

* cited by examiner

*Primary Examiner*—Steve Alvo
(74) *Attorney, Agent, or Firm*—David L. Hedden

(57) ABSTRACT

The invention relates to a process for digesting woodchips used in papermaking. The process employs digester additive, which comprises a sultaine or mixtures of a sultaine with a nonionic surfactant selected from the group consisting of (a) polyglycosides, (b) polyoxyalkylene glycols, and (c) mixtures thereof as digester additives. The digester additives are compatible and stable at elevated temperatures in the highly alkaline white liquor used in the digestion of woodchips into pulp. The invention also relates to the digester additive compositions.

4 Claims, No Drawings

PROCESS FOR DIGESTING WOODCHIPS WITH A SULTAINE AND A POLYGLYCOSIDE

CLAIM TO PRIORITY

Applicants hereby claim priority to U.S. provisional application serial No. 60/221,663 filed on Jul. 27, 2000, which is hereby incorporated by reference.

FIELD OF THE INVENTION

The invention relates to a process for digesting woodchips used in papermaking. The process employs a digester additive, which comprises a sultaine or mixtures of a sultaine with a nonionic surfactant selected from the group consisting of (a) polyglycosides, (b) polyoxyalkylene glycols, and (c) mixtures thereof as digester additives. The digester additives are compatible and stable at elevated temperatures in the highly alkaline white liquor used in the digestion of woodchips into pulp. The invention also relates to the digester additive compositions.

BACKGROUND OF THE INVENTION

In the Kraft process for making paper, woodchips are cooked (digested) in a digester at an elevated temperature in white liquor. The white liquor is essentially a caustic solution containing polysulfides. The woodchips swell in the presence of the caustic and the polysulfides penetrate into the capillaries of the wood. This process dissolves the lignin in the woodchips that binds the wood fibers of the wood together. Ideally, all of the woodchips are cooked uniformly during the digestion process. However, in practice, not all of the fibers in woodchips will be separated. Any unseparated particles will be classified as "rejects". If a large quantity of rejects are screened out during this pulping process, "low yield" (defined as dry weight of pulp produced per unit dry weight of wood consumed) results.

Over the years, anthraquinone (AQ) was and is still successfully used in the pulping industries as a digester additive. AQ enhances the pulping rate, and most importantly, reduces the amount of "rejects" and leads to increases in yield. However, AQ can be expensive to use and it is relatively insoluble in white liquor, even at an elevated temperature. This insolubility in white liquor creates processing problems, such as pipe and screen plugging, and scaling in the digester. It is also known that the use of AQ detrimentally affects the tall oil by-product recovered during the pulping process.

In order to obviate the problems associated with using AQ, surfactants are added to the white liquor to reduce or eliminate the plugging and scaling problems normally encountered with AQ. In addition, certain surfactants and surfactant blends are known to provide wetting properties that allow quick and more uniform penetration of the cooking liquor into the capillaries of woodchips, thus reducing the "rejects" as well as reducing the cooking time. U.S. Pat. Nos. 4,906,331 and 5,127,993 disclose the use of polyoxyalkylene glycols' (POGs') that can reduce rejects and increase yield. However, these POGs (such as PLURONIC® F108 & L-62 polyols) are not compatible in the alkaline white liquors.

U.S. Pat. Nos. 5,298,120 and 5,501,769 disclose a digester additive that is a diester of the same POGs reacted with oleic acid. The patents indicate that the diester results in improved dispersability in the white liquor. With heat in alkaline white liquor, the diester will saponify (hydrolyze) back to the original POGs for them to work. Since it takes time for the saponification to occur, these diesters by then is already dispersed in the white liquor resulting in a relatively more uniform cooking of the woodchips in the digester.

U.S. Pat. No. 5,250,152 discloses a blend of ethoxylated alcohols and dialkylphenols as digester additives that can increase yields and reduce rejects. U.S. Pat. Nos. 6,036,817 and 5,728,265 disclose a number of surfactants, including sulfosuccinates, polyglycosides, and poly(methylalkylsilicone) as chip penetrating aids.

JP Patents 06033386 & 07527528 disclose the use of AQ and surfactants (including ethoxylate secondary alcohols and alkyphenols blends). WO 9529288 claims AQ treated with rosin with a polyvalent metal and water-soluble surfactant. DE 3905311 discloses AQ with substituted polyglycol ether like alkylphenol or naphthol of a 2-ring aromatic hydroxy compound with 4–20 moles of EO. These inventions emphasize a lower AQ level usage complemented by surfactants in an attempt to reduce the problem of AQ scaling and plugging during pulping.

Ethoxylated alkylpenols, dialkyl phenols, both primary and secondary alcohols, are also documented in many disclosures. However, they are neither soluble nor dispersible in the highly alkaline white liquor rendering them marginally less effective. At elevated temperature above 150° C., the solubility of these surfactants worsens. This issue is addressed in U.S. Pat. Nos. 5,298,120 and 5,501,769, which disclose attempts to disperse the POG uniformly throughout the white liquor by transforming the POGs' into its diester equivalent before use.

SUMMARY OF THE INVENTION

The invention relates to a process for digesting woodchips used in papermaking. The process comprises adding an effective amount of a digester additive to a mixture comprising pulping woodchips and white liquor. The digester additive comprises a sultaine or a mixture of a sultaine and a nonionic surfactant selected from the group consisting of (a) polyoxyalkylene glycols, (b) polyglycosides, and (c) mixtures thereof to a mixture. The digester additives are compatible and stable at elevated temperatures in the highly alkaline white liquor used in digestion of woodchips into pulp. The invention also relates to the digester additive compositions.

The digester additives are effective in reducing both the Kappa number and percentage of rejects during the cooking of woodchips to pulp. However, unlike most surfactant-based digester additives used commercially, the digester additives are miscible with and effective with highly alkaline white (cooking) liquors having high solids, especially at temperature >160° C. The use of the digester additives results in the uniform cooking of the woodchips in the digester, improved yield of woodpulp and a decrease in % rejects, and a lack of deposits on the digesting equipment that is commonly associated with the use of anthraquinone.

BEST MODE AND OTHER MODES OF PRACTICING THE INVENTION

Sultaines are a class of amphoteric surfactants that are low-foaming and alkaline stable in white liquor. Illustrative examples of sultaines that can be used in practicing the invention are disclosed in U.S. Pat. No. 4,891,159, which is hereby incorporated by reference. The preferred sultaines are alkylether hydroxylpropyl sultaines having the structure:

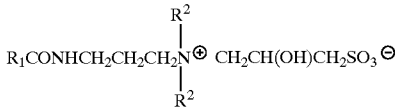

where $R_1$, which may be the same or different than $R_2$, is an alkyl group having from 2–18 carbon atoms, and $R_2$, which may be the same or different, is an alkyl group having from 1–3 carbon atoms, and is preferably a methyl group.

Alkylether hydroxylpropropyl sultaines can be made by reacting a fatty acid with dimethylaminopropylamine followed by alkylation with sodium-3-chloro-2-hydroxylpropane sulfate.

The polyglycosides used as the nonionic surfactant in the mixtures of a sultaine and a nonionic surfactant include glycosides and glycoside derivatives such as alkyl glycosides, alkoxylated alkyl glycosides, polyglycosides, polyalkylglycosides, alkoxylated polyalkylglycosides, alkylpolysaccharides, and the like. A glycoside is a composition comprised predominantly of an acetal or ketal of a saccharide with an alcohol. Typical saccharides from which the glycoside is derived include glucose, fructose, mannose, galactose, talose, gulose, allose, altrose, idose, arabinose, xylose, lyxose and ribose. The preferred glycosides are glucosides due to the ready availability of glucose as a starting material. The synthesis of alkyl glycoside and polylglycosides are disclosed in U.S. Pat. Nos. 3,598,865; 3,721,633; 3,772,269; 3,640,998; and 3,839,318, which are hereby incorporated by reference.

Alkyl and alkoxy polyglycosides, preferably alkyl polyglycosides for use in the present invention have the formula:

$$R_1O\ (\text{glycosyl})x$$

where $R_1$ is selected from the group consisting of alkyl, alkylphenyl, hydroxyalkyl, hydroxyalkylphenyl, and mixtures thereof in which the alkyl groups contain from about 6 to about 30, preferably from about 8 to about 16, carbon atoms; x is 1 to 5, preferably 1 to 4. The glycosyl is preferably a monosaccharides (glucose). To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

Alkylpolysaccharides are disclosed in U.S. Pat. No. 4,565,647. These compositions have a hydrophobic group containing from about 6 to about 30 atoms, preferably from about 10 to about 16 carbon atoms and a polysaccharide, e.g., a polyglycoside, hydrophilic group containing from about 11/2 to about 10, preferably from about 11/2 to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties.

Typical hydrophobic groups include alkyl groups, either saturated or unsaturated, branched or unbranched containing from about 6 to about 30, preferably from about 8 to about 16, carbon atoms. Preferably, the alkyl group is a straight chain saturated alkyl group. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses.

The polyoxyalkylene glycols used as the nonionic surfactant in the mixtures of a sultaine and a nonionic surfactant are preferably block copolymers of polyethylene oxide (EO) and polypropylene oxide (PO) and are represented by the general formula:

$$HO—(EO)_m—(PO)_n—(EO)_m—OH$$

where m, which may be the same or different, is a number from 0.5 to 50, preferably 1 to 50, and n is a number from 10 to 100, preferably from 10 to 65.

The block copolymers are generally described in U.S. Pat. No. 2,999,045 and U.S. Pat. No. 4,906,331, which are incorporated herein by reference. Such block copolymers are available from BASF under the name trademark PLURONIC. Examples include PLURONIC L-44, PLURONIC L-62, PLURONIC L-64, PLURONIC F-68, PLURONIC F-108, and PLURONIC F-127 polyols. The average molecular weight of the preferred polyoxyalkylene polyols is from about 500 to about 30,000. Particularly preferred are block copolymers having an average molecular weight of about 1,100 to 15,000 having from about 10–80 weight percent polyethylene oxide and from about 90–20 weight percent polypropylene oxide, where said weight percent is based upon the weight of the block copolymer.

The digester additive may also contain anthraquinone (preferably no more than about 1.0% weight percent based upon the weight percent of the pulping woodchips), white liquor, and other additives.

White liquor is an aqueous mixture comprising chemicals such as caustic soda, sodium sulfate, sodium carbonate, and sodium sulfide, polysulfides, etc. used in pulping woodchips for papermaking. Examples of pulping woodchips include hardwood, softwood and their mixtures.

Amounts of Components

Generally, the amount of surfactants POG (a) or PGS (b) used in conjunction with the sultaine is from about 0 to 80 weight percent, preferably from about 0 to 50 weight percent, where the weight percent is based upon the amount of sultaine. The weight ratio of sultaine to (a) or (b) is from about 10:90 to 90:10, preferably from 40:60 to 60:40. The amount of digesting aid, sultaine plus surfactants (a) and (b), used in the process, is from about 0.05% to 1.00% based upon the weight of air-dried woodchips used in the white liquor, preferably from 0.125% to 0.25%. The amount of woodchips to white liquor used in the process typically ranges from 10 to 40 weight percent based on the weight percent of the white liquor.

ABBREVIATIONS AND DEFINITIONS

The following abbreviations are used in the Examples:

| | |
|---|---|
| AQ = | Anthroquinone. |
| Sultaine = | Mirataine ASC sold by Rhodia. It is low foamy, has good wetting properties and caustic stable. |
| H-Factor = | a single numerical value for expressing the combined 2 values of digester cooking time and pulping temperature for each cooking cycle. This enables changes to be made in the time-temperature cycle while maintaining a constant degree of delignification. |
| Kappa number = | a number indicative of the relative bleachability or degree of delignification of pulp. The Kappa number Test is the volume (in milliliters) of 0.1 N potassium permanaganate consumed by 1 gram of moisture free pulp. Generally, the higher the Kappa number, the more lignin present in the pulp. The Kappa number generally decreases as the digestion time and/or the alkalinity of the cooking liquor |

-continued

| | |
|---|---|
| | are increased. |
| Percent (%) Rejects = | the dried weight of unseparated particles that are screened out after digestion. |
| POG = | Polyoxyalkylene glycol having an average molecular weight of about 1100 to 15,000 and an ethylene oxide to propylene oxide ratio of range from 10% to 80% and sold under the trademark PLURONIC ®. |
| PGS = | Glucopon 425 N, an alkyl alkoxylated polyglycoside sold by Henkel. It has excellent wetting properties and caustic stable. |
| Yield = | the weight of dried pulp produced after digestion of a known weight of dried woodchips. |

EXAMPLES

The examples will illustrate specific embodiments of the invention. These examples along with the written description will enable one skilled in the art to practice the invention. It is contemplated that many other embodiments of the invention will work besides these specifically disclosed. All parts are by weight and all temperatures are in ° C. unless otherwise specified. The Control contains no additive. The Comparative Examples are designated by letters.

Test Procedure Used to Evaluate Digester Additives

A mixture of hardwood and softwood woodchips with mill white liquor in a ratio of 1:4 were added into a laboratory autoclave. The autoclave was sealed and the mixture was heated to a certain H-Factor. H-Factor is a single numerical value for expressing the 2 combined values of digester time and pulping temperature. All comparable tests were conducted using the same H-Factor, i.e. @170° C. for the same 2–3 hours, depending by woodchips type. The woodchips were deliberately undercooked using the same H-Factor. This was to help in determining the discernible differences after each digestion, especially in % yield, % rejects and Kappa numbers.

Ideally, woodchips should be digested to dissolve most of the lignins to free up the cellulosic fibers, but maintain sufficient lignin to provide added strength of the paper produced. An effective pulping aid should produce a high % yield with a low % of rejects at a low or constant Kappa number.

The test results are set forth in Table I that follows:

TABLE I

Test Result Summary

| Example | DIGESTER | % REJECT | % YIELD | KAPPA NUMBER | SOLUBILITY |
|---|---|---|---|---|---|
| CONTROL | BLANK | 1.44 | 50.72[1] | 45.30 | — |
| COMP A | AQ | 0.24 | 45.52 | 32.48 | INSOLUBLE |
| COMP B | POG | 1.52 | 49.72 | 41.60 | INSOLUBLE |
| COMP C | PGS | 1.40 | 50.32[2] | 44.60 | SOLUBLE |
| COMP D | Sultaine | 0.84 | 50.68 | 43.21 | SOLUBLE |
| 1 | Sultaine/PGS | 0.44 | 50.40 | 40.58 | SOLUBLE |
| 2 | Sultaine/POG | 0.56 | 49.80 | 42.08 | SOLUBLE |

[1]High lignin content.
[2]High lignin content.

The % reject for the Control at 1.44 was high. Although it had a high % yield of 50.72, this high % yield could be explained by the presence of a substantial amount of undissolved lignin still trapped in the handsheet that was prepared after each cook. This was verified by its Kappa number of 45.30.

As expected, comparative Example A (anthraquinone or AQ) gave the lowest % reject at 0.24. However, the % yield (45.50) was low and it had a low lignin content, as suggested by the light color pulp, which was consistent with the low Kappa number (32.48). This low yield resulted because most of the lignin in the woodchips, after the cook, was already washed from the pulp. The problem with using the AQ was that it was insoluble in the white liquor, even at higher temperatures.

Comparative Example B (POG, which is PLURONIC L62 polyol) had a high yield and low Kappa number. The low Kappa number demonstrated that POGs are effective pulping aids. However, being insoluble in white liquor, they were not being uniformly dispersed in the white liquor, resulting in high reject rate of 1.52%.

Comparative Example C (PGS) indicated that the polyglycoside thought soluble in the white liquor had a high Kappa number of 44.6, and was less effective than POGs. The % of rejects at 1.4 was also high.

As Table I shows, the sultaine surfactant (Example 1), and mixtures of blends of sultaine with POG and PSG (Examples 2–3), which are within the scope of this invention, were the only digester additives that were soluble at room and elevated temperature in white liquor and provided an acceptable reject percentage. In addition, the digester additives used in Examples 1–3 provided a high yield and a lower Kappa number than the Control.

We claim:

1. A process for digesting woodchips used in papermaking comprising:

adding an effective digesting amount of a digesting additive comprising a
(a) sultaine, and
(b) a nonionic polyglycoside surfactant, wherein the weight ratio of sultain to nonionic surfactant is from about 10:90 to 90:10 to a slurry of woodchips and white liquor digesting the woodchips to produce pulp.

2. The process of claim 1 wherein the amount of digesting additive is from about 0.05% to 1.00% based upon the weight of the woodchips digested.

3. The process of claim 1 wherein the wherein the polyglycoside is n alkyl alkoxy polyglycoside having the following structural formula:

$$R_1O\text{-(glycosyl)},$$

where $R_1$ is selected from the group consisting of alkyl, alkylphenyl, hydroxyalkyl, hydroxyalkylphenyl, and mixtures thereof in which the alkyl groups contain from about 6 to about 30; and x is from about 1.0 to about 10; and glycosyl is a monosaccharide unit.

4. The process of claim 3 wherein the weight ratio of sultaine to polyglycoside in the surfactant blend is from about 40:60 to 60:40.

* * * * *